US005467256A

United States Patent [19]

Chen

[11] Patent Number: 5,467,256

[45] Date of Patent: Nov. 14, 1995

[54] KNIFE WITH LIGHTING FIXTURE

[75] Inventor: Shun-fu Chen, Taipei Hsien, Taiwan

[73] Assignee: Chia Yi Enterprise Co., Ltd., Taiwan

[21] Appl. No.: 367,847

[22] Filed: Jan. 3, 1995

[51] Int. Cl.[6] ..... B25B 23/18

[52] U.S. Cl. ..... 362/119; 362/109; 30/123

[58] Field of Search ..... 362/109, 119, 362/120, 190, 191; 30/122, 123

[56] References Cited

U.S. PATENT DOCUMENTS 4,669,186 6/1987 Liu ..... 362/199 X 5,402,575 4/1995 Maxcy ..... 362/119 X

FOREIGN PATENT DOCUMENTS 77210307 10/1988 Taiwan .

*Primary Examiner*—Stephen F. Husar

*Attorney, Agent, or Firm*—Beveridge, DeGrandi, Weilacher & Young

[57] ABSTRACT

Disclosed is a knife with lighting fixture which mainly consists of a pair of cases, a pivotally turnable knife, and a pivotally turnable supporting plate. The supporting plate has a cell, a bulb, and a push button supported thereon. The push button is slightly projected from one of the case so that a depression of it may lighten the bulb to shine toward the knife for convenient use in a dark place. The supporting plate may be easily turned out of the cases for mounting a new cell and/or a new bulb when necessary.

2 Claims, 5 Drawing Sheets

KNIFE WITH LIGHTING FIXTURE

BACKGROUND OF THE INVENTION

The present invention relates to a knife structure, and more particularly to a knife with lighting fixture for use in a dark place and easily replacement of cell and bulb thereof.

Knife is a common and widely used tool and has variously designed structures, such as a kinfe with its blade foldable or retractable into a handle thereof. Some knives are provided with lighting fixture. An example of such knofe with lighting fixture is disclosed by Taiwan Utility Patent Application No. 77210307 entitled "A spring-loaded toy knife with lighting fixture". The knife disclosed by the Taiwan Patent Application No. 77210307 mainly consists of a rotatable knife body, a knife handle including two cases and pivotally connected with the knife body, a sting member disposed between the knife body and the knife handle at the pivotal connection thereof to enable the rotation of the knife body relative to the knife handle, a conductive leaf spring which may be moved along with the rotation and springing out of the knife body, and a lighting fixture provided at a front portion of the knife handle at an adequate point within the travel of the conductive leaf spring. The knife body has a small hole and a pivot hole for the knife body to be pivotally connected to a rod provided at an inner front of the knife handle. One of the cases of the knife handle is provided with an elongated slot to confine a push member therein but allows the same to freely move back and forth in the slot. The push member connects a driven member provided at an inner side of the case and the driven member has a brake rod. The brake rod may be driven by the push member to engage with a recess provided at one lateral side of the knife body at a lower rear end thereof and thereby causes the knife body to spring out of and rotate relative to the knife handle with the conductive leaf spring having one end fixed to an inner end surface of the knife handle and another free end simultaneously contacting with the lighting fixture.

The knife with lighting fixture disclosed by the Taiwan patent application No. 77210307 has very complicate structure and is difficult to assemble. The long battery increases the volume and weight of the cases. In addition, the bulb thereof is completely locked into the cases and is therefore, very difficult to replace it in the event it is burned out. This is of course a big shortcoming in the structure of the disclosed knife.

SUMMARY OF THE INVENTION

A primary object of the present invention is to provide a knife with lighting fixture of which the lighting fixture is disposed at a position easy for the user to control and directly shines the cutting edge of the knife to help the user to conveniently operate the knife even in the dark.

Another object of the present invention is to provide a knife with lighting fixture of which the lighting fixture can be conveniently pulled away from the knife handle for the user to replace the cell.

BRIEF DESCRIPTION OF THE DRAWINGS

The above and other objects of the present invention as well as the structure and functions thereof can be best understood through the following detailed description of the preferred embodiment and the accompanying drawings wherein.

DETAILED DESCRIPTION OF THE PREFERRED EMBODIMENT

Figure 1:
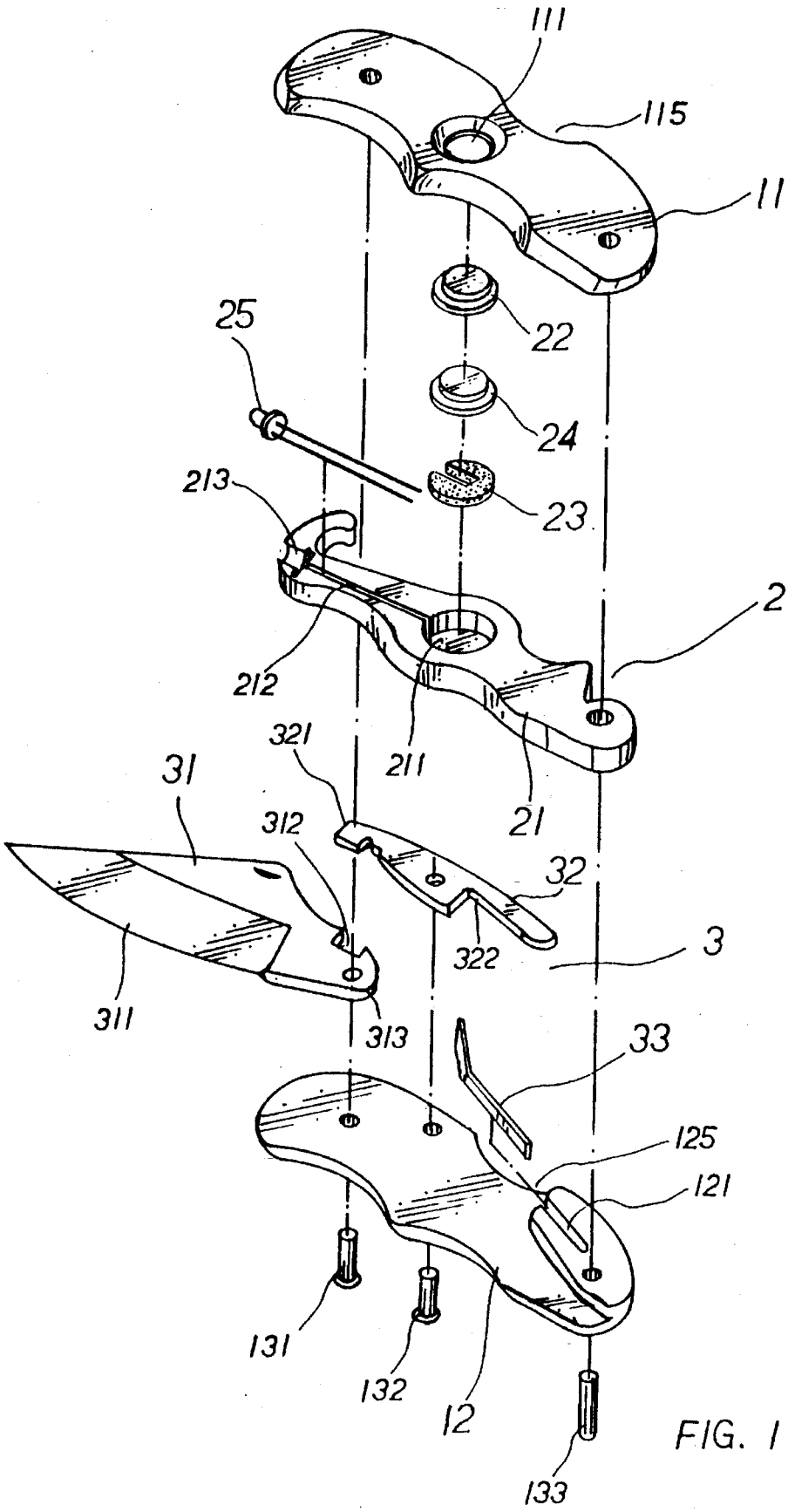
FIG. 1 is an exploded perspective of an embodiment of the present invention.
Figure 2:
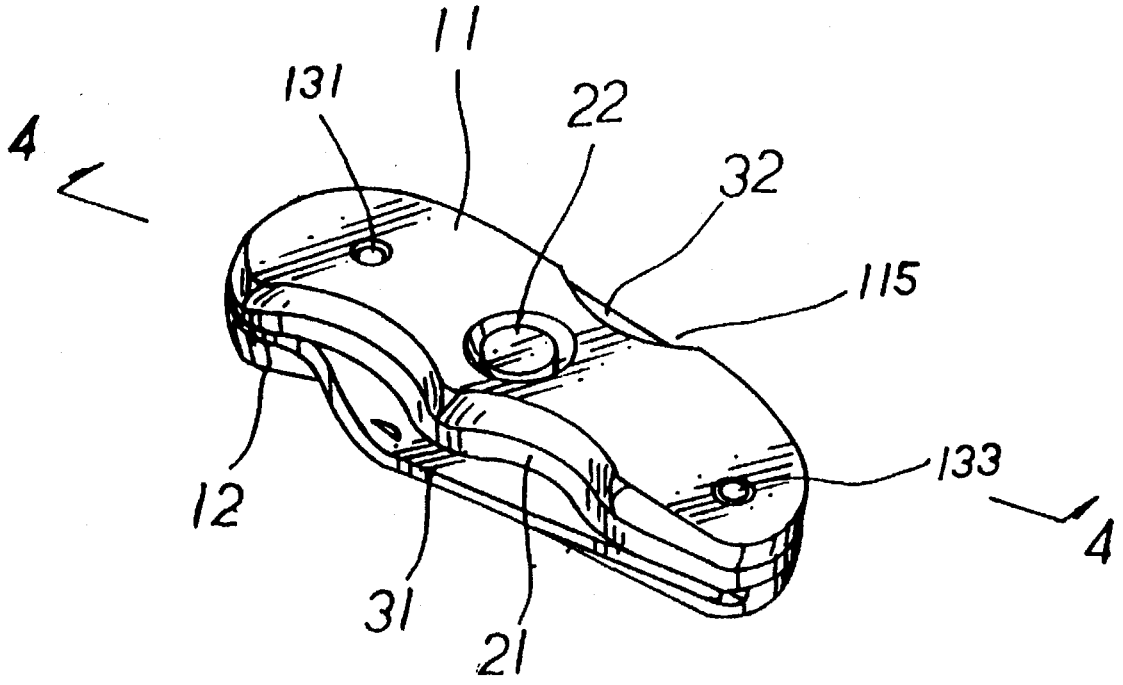
FIG. 2 is an assembled perspective of the present invention according to FIG. 1.

Please refer to FIGS. 1 and 2. The present invention mainly includes a handle consisting of a first case 11 and a second case 12 having a substantially symmetrical profile to receive between them a lighting fixture 2 and a knife control mechanism 3.

The knife control mechanism 3 mainly consists of a knife 31, a control plate 32, and a spring member 33. The knife 31 has a cutting edge 311 and a retaining dent 312 formed at an end of the knife 31 opposite to the cutting edge 311 to fitly and detachably receive a retaining head 321 formed at a front portion of the control plate 32. The knife 31 also has a smoothly curved end 313 opposite to a pointed end of the cutting edge 311. By means of a first pivot 131 passing through holes separately formed at front portions of the first and the second cases 11, 12 and near the curved end 313 of the knife 31, the knife 31 may conveniently and pivotally turned about the first pivot 131 relative to the first and the second cases 11, 12. The control plate 32 has a front retaining head 321 which may fitly and detachably engage into the retaining dent 312 of the knife 31, a rear end having a recess 322 formed at a side facing the knife 31 to press against a front part of the spring member 33. The control plate 32 is movably attached to the second case 12 by means of a second pivot 132 which passes through holes separately formed at middle portions of the second case 12 and the control plate 32. The spring member 33 is generally L-shaped with its upward projected front part pressing against the recess 322 of the control plate 32 and its rear part extending into and lying on a locating groove 121 formed on an inner surface of the second case 12, such that the spring member 33 has enough resiliency to provide the control plate 32 with sufficient recovery force.

Figure 4:
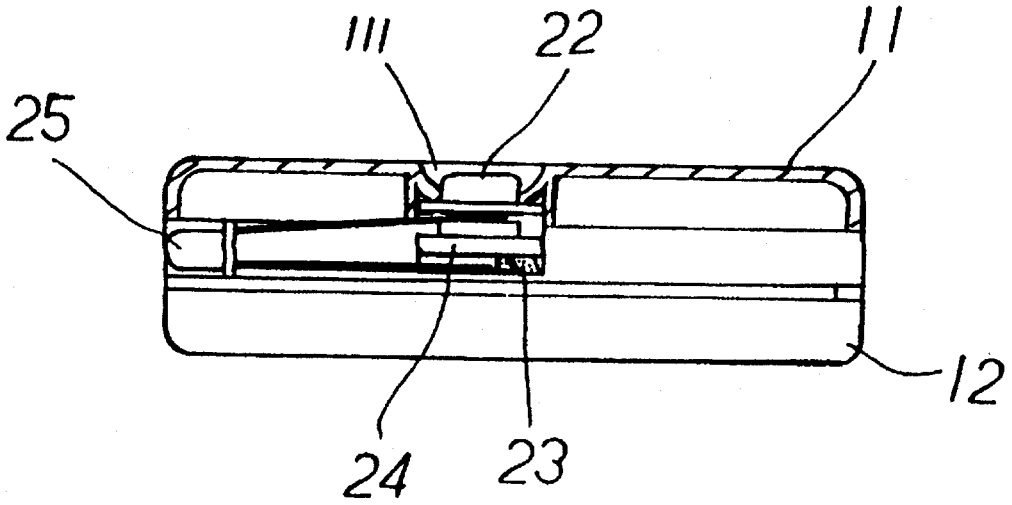
FIG. 4 is a cross-sectional view taken on line 4—4 of FIG. 1.
Figure 5:
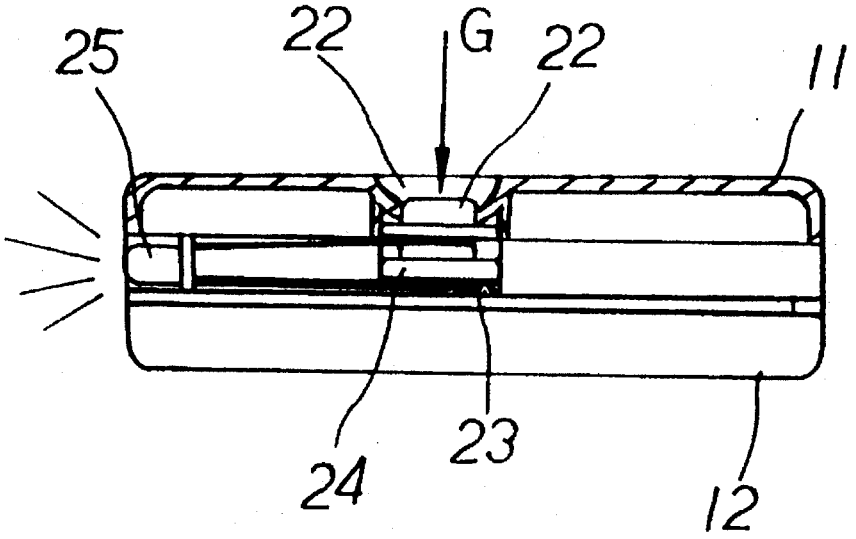
FIG. 5 is a cross-sectional view similar to FIG. 4, with the push button being depressed to lighten the bulb.

The lighting fixture 2 includes a supporting plate 21 pivotally disposed between the first and the second cases 11, 12 by means of a third pivot 133 passing through holes separately formed at rear portions of the first and the second cases 11, 12 and the supporting plate 21, a push botton 22, a sponge pad 23, a round cell 24, and a bulb 25. The supporting plate 21 is formed at a middle portion with a through opening to serve as a cell seat 211 for receiving the sponge pad 23 and the round cell 24 therein. An elongated groove 212 extends from the cell seat 211 toward-a front end of the supporting plate 21 opposite to the hole formed at the rear portion of the supporting plate 21 through which the third pivot 133 passing to connect the first and the second cases 11, 12 and the supporting plate 21 together. A bulb seat 213 is formed at the most front of the long groove 212 to receive the bulb 25 therein. The bulb 25 has a positive and a negative pole pieces extending from a rear end of the bulb 25 into and along the long groove 212 to respectively connect with a positive and a negative poles of the cell 24. The push botton 22 is disposed above the cell 24 with its top portion slightly projecting from a through opening 111 formed on the first case 11 corresponding to the cell seat 211. The sponge pad 23 is disposed directly above a bottom of the cell seat 211 and is formed at one side facing the long groove 212 with a long cutout to receive one of the pole pieces of the bulb 25 therein. The sponge pad 23 also serves as a cushion for the push button 24 to keep the bulb 25 and the two poles of the cell 24 in a normally disconnected relationship, as shown in FIG. 4. The pole pieces of the bulb 25 contact with the two poles of the cell 24 and form a closed circuit to lighten the bulb 25 only when the push button 22 is depressed in a direction as shown by the arrow G in FIG. 5.

Figure 3:
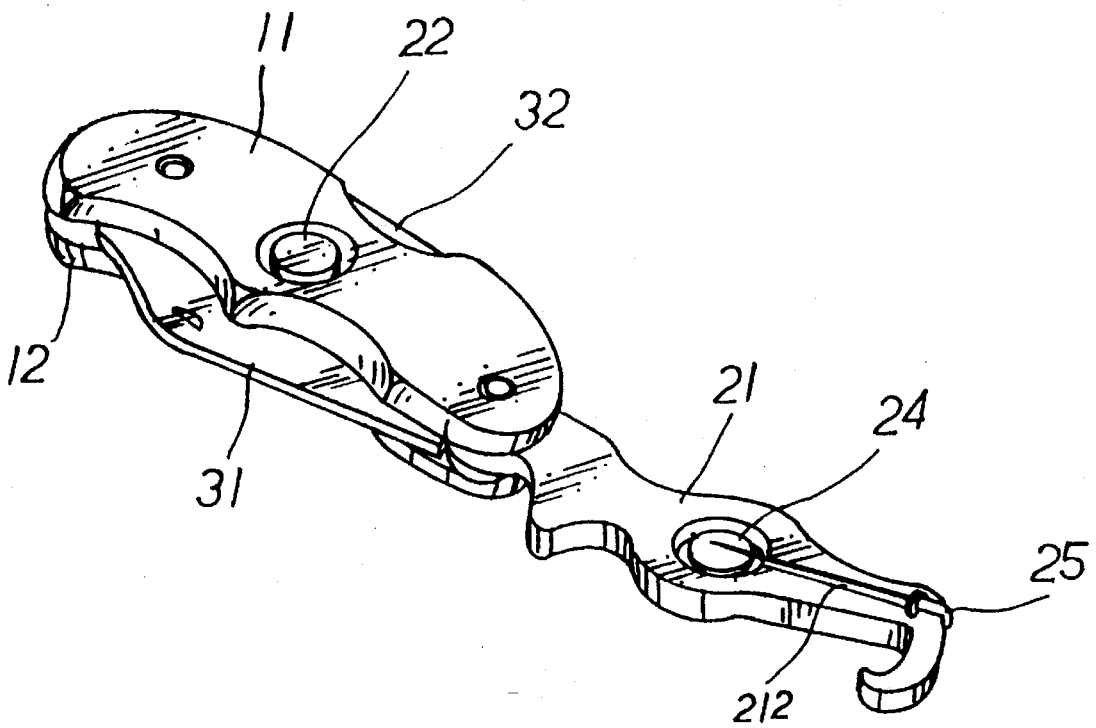
FIG. 3 is an assembled perspective of the present invention according to FIG. 1, with the lighting fixture thereof being pulled away from the knife cases.

FIG. 3 illustrates the present invention with the lighting fixture 2 being turned about the third pivot 133 to move out of the first and the second cases 11, 12. The supporting plate 21 of the lighting fixture 2 in this outward position facilitates the replacement of the old cell and/or bulb with the new ones. After the new cell is placed into the cell seat 211, first turn the whole knife upside down so that the push button 22 projects its top surface out of the through opening 111. Then the supporting plate 21 is turned back into and between the first and the second cases 11, 12. The supporting plate 21 has a hook-like front portion which facilitates the stable fixing of the whole lighting fixture 2 to the cases 11, 12 without easily moving out of the cases 11, 12.

The bulb 25 is so positioned that, when the push button 22 is depressed to electrically connect the bulb 25 and the cell 24, it shall directly shine toward the cutting edge 311 of the knife 31 when the latter is pivotally turned out of the cases 11, 12 for use by a user in a dark place. Moreover, the push button 22 projects from the first case 12 at a position which just permits the user to conveniently press the push button 22 without influencing the operation of the knife 31 by the user at the same time.

Figure 6:
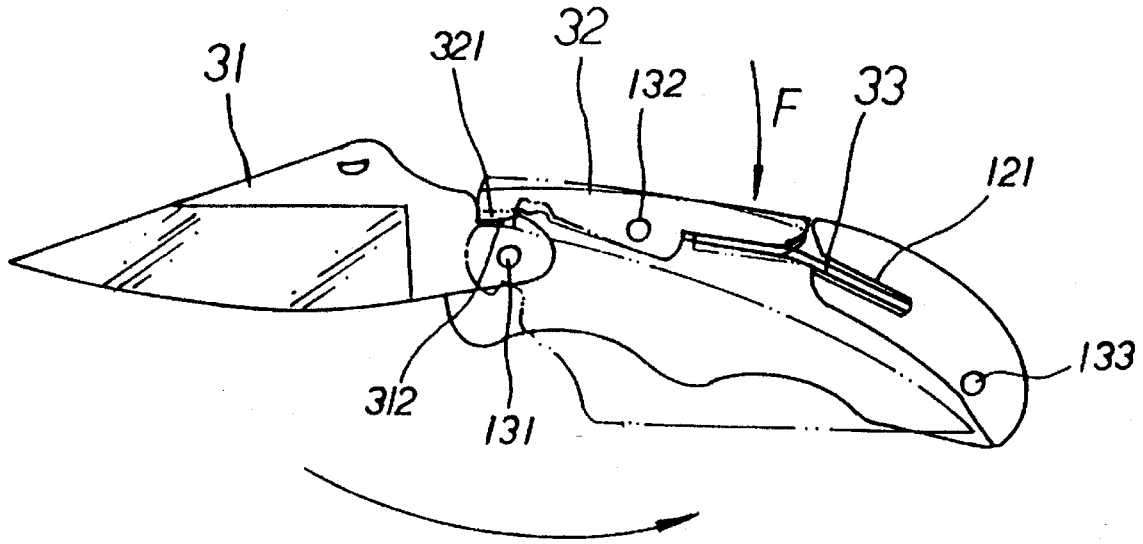
FIG. 6 illustrates the manner in which the knife is turned back to be received in the knife cases.

FIG. 6 illustrates the turning back of the knife 31 into the two cases 11, 12. The front part of the sting member 33 presses against the control plate 32 at its recess 322 so that the control plate 32 is normally exposed to outside from recesses 115 and 125 respectively formed on one side of the first and the second cases 11, 12 opposite to the side to where the knife 31 is adjacent. When the knife 31 is pulled out from the two cases 11, 12, the curved end 313 of the knife 31 permits the knife 31 to be smoothly turned about the first pivot 131 and moved to an extended position in the direction as shown by the solid line in FIG. 6. The extended knife 31 is fixedly retained to a final position without being turnable anymore when the front retaining head 321 of the control plate 32 engages with the retaining dent 312 of the knife 31. To close the knife 31 into the cases 11, 12 again, just apply force on the control plate 32 in a direction shown by Arrow F in FIG. 6, causing the control plate 32 to turn about the second pivot 132 as shown by the dotted line in FIG. 6. At this point, the front retaining head 321 is disengaged from the retaining dent 312, allowing the knife 31 to be turned back into the two cases 11, 12.

The control means 3 of the knife may be replaced by other suitable mechanisms, such as a spring-loaded knife mechanism or any other folding mechanism. However, the lighting fixture 2 shall always be maintained in the same structure so as to provide light to the knife, especially to the cutting edge thereof.

What is claimed is:

1. A knife with lighting fixture, comprising a first and a second cases having a substantially symmetrical profile;

a knife control mechanism being disposed between said first and said second cases and including a knife which can be pivotally turned about said cases to be extended out of or received in said cases; and a lighting fixture consisting of a supporting plate being pivotally connected between said first and said second cases and having a cell seat to receive a cell therein, an elongated groove extending from said cell seat toward a front end of said supporting plate, and a bulb seat formed in front of said elongated groove to receive a bulb therein; said bulb having two pole pieces separately connected to a corresponding pole of said cell received in said cell seat; and said lighting fixture further consisting of a push button disposed above said cell with a top surface thereof slightly projecting from said first case; and said bulb being shining when said push button is depressed to electrically connect said pole pieces of said bulb with said corresponding poles of said cell and directly lighting a cutting edge of said knife when said knife is pivotally turned relative to said cases to a completely extended position.

2. A knife with lighting fixture as claimed in claim 1, wherein a sponge pad is disposed at a bottom of said cell seat below said cell, said sponge pad being formed with a long cutout to receive an end of one of said pole pieces of said bulb and serving as a cushion for said push button so that said pole pieces of said bulb and said poles of said cell are in a normally disconnected relationship.

* * * * *